US006191741B1

(12) United States Patent
Gauld et al.

(10) Patent No.: US 6,191,741 B1
(45) Date of Patent: Feb. 20, 2001

(54) DUAL MODE ANTENNA FOR PERSONAL COMPUTER CARD

(75) Inventors: Craig S. Gauld, Vancouver; Ronald J. Vanderhelm, Surrey; Andrey Gleener, Burnaby, all of (CA)

(73) Assignee: Sierra Wireless, Inc., Richmond (CA)

( * ) Notice: Under 35 U.S.C. 154(b), the term of this patent shall be extended for 0 days.

(21) Appl. No.: 09/187,074

(22) Filed: Nov. 6, 1998

(51) Int. Cl.[7] ..... H01Q 1/24
(52) U.S. Cl. ..... 343/702; 343/900; 343/901
(58) Field of Search ..... 343/702, 900, 343/901; 455/90; H01Q 1/24

(56) References Cited

U.S. PATENT DOCUMENTS 4,270,128 * 5/1981 Drewett ..... 343/702
5,212,491 * 5/1993 Chin et al. ..... 343/901
5,455,595 * 10/1995 Yokoyama et al. ..... 343/901

* cited by examiner

*Primary Examiner*—Hoanganh Le
(74) *Attorney, Agent, or Firm*—Burns, Doane, Swecker & Mathis, LLP

(57) ABSTRACT

An extendable antenna for a personal computer card uses two main antenna elements. A movable antenna element can be positioned in an extended position such that the base of the second antenna element electrically contacts the top of the other antenna element. The antenna in the extended position is connected to the antenna port through matching circuitry. In a closed position of the antenna, the second antenna element is electrically connected to the antenna port bypassing the matching circuitry. In one embodiment, the antenna is a quarter-wave length antenna in the closed position and a half-wave length antenna in the extended position.

23 Claims, 3 Drawing Sheets

DUAL MODE ANTENNA FOR PERSONAL COMPUTER CARD

BACKGROUND OF THE INVENTION

1. Field of the Invention

The present invention generally relates to antennas for personal computer card modems or radios.

2. State of the Art

Integrated circuit cards, particularly cards conforming to the Personal Computer and Memory Card International Association (PCMCIA) standards, have become a mainstay of mobile computing. PCMCIA cards are available in a variety of form factors including, in order of increasing thickness, Type I, Type II, and Type III cards. A variety of devices use the PCMCIA format including memory cards, modems, disc drives, etc. In particular, the development of mobile computing has resulted in an increased demand for wireless modems.

An example of an antenna for use with a PCMCIA modem card is described in the patent, Stein et al., U.S. Pat. No. 5,628,055. This reference shows a PCMCIA card with a conventional rotatable antenna.

It is desired to have improved antenna for use with a PCMCIA card.

SUMMARY OF THE INVENTION

The present invention generally relates to an antenna for a use with a personal computer card modem having a "closed" position and an "expanded" position. The antenna has two main elongated elements: a first antenna element and a movable second antenna element. In the "expanded" position, the two antenna elements are electrically connected to form a single large antenna, which is connected to an antenna port through an impedance matching circuit. In the "closed" position, the movable second antenna element is directly connected to the antenna port by-passing the impedance matching circuit.

The antenna can thus work in two different configurations. The operation of the antenna does not rely on the user remembering to expand the antenna. The bypass switch allows the shorter antenna configuration to have a good impedance match and thus improves the gain of the shorter antenna configuration. In one embodiment of the present invention, each of the two antenna elements is about a fourth of the length of the center wavelength transmitted/received. Thus, the expanded antenna is roughly a half wavelength antenna, and the closed antenna is roughly a quarter wavelength antenna. The impedance matching for the "closed" quarter wave length antenna is improved when the matching circuitry for the "extended" half wavelength antenna is by-passed.

In one embodiment, the first antenna element is a conductive trace formed on a circuit board. The impedance matching circuit can be placed on the circuit board, as well.

The base of the second antenna element preferably forms a contact for selectively connecting to a bypass switch or to the top of the first antenna element. The second antenna element can be shaped so that it is preferentially held in either the fully closed or fully extended positions. This can be done by making the antenna element thicker at the conductive base to allow a friction fit both at the fully extended and fully closed positions.

BRIEF DESCRIPTION OF THE DRAWINGS

The present invention may be further understood from the following description in conjunction with the appended drawings. In the drawings.

DETAILED DESCRIPTION OF THE PREFERRED EMBODIMENT

Figure 1A:
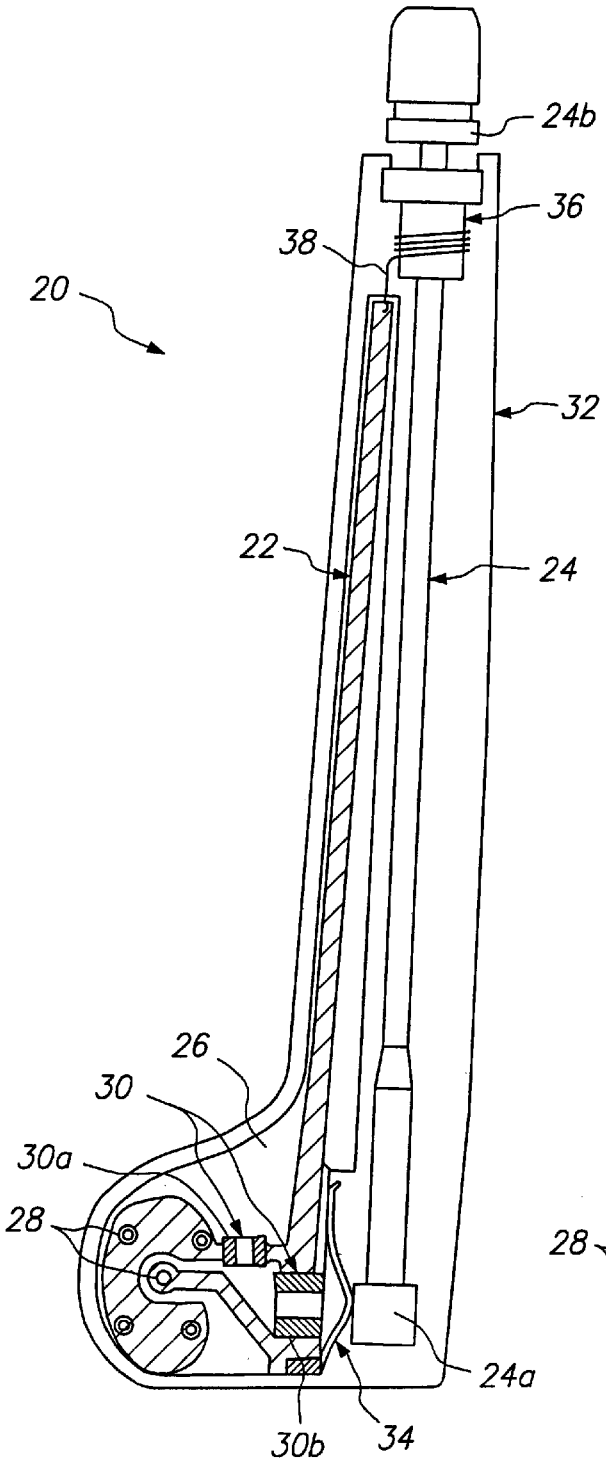
FIG. 1A is a diagram of the antenna of the present invention in the "closed" position.

FIG. 1A shows one embodiment of the antenna 20 of the present invention with the antenna in its "closed" position. The antenna 20 has two main antenna elements; a first antenna element 22, and a movable second antenna element 24. The movable second antenna can be positioned between the "closed" position shown in FIG. 1A and an "extended" position shown in FIG. 1B.

Looking again at FIG. 1A, the first antenna element 22, in one preferred embodiment, is comprised of a metal trace formed on a circuit board 26. A matching circuit 30 is positioned between the first antenna element 22 and the antenna port. In a preferred embodiment, the antenna port comprises a 50 Ω coax connector that connects to the circuit board through pins 28. The matching circuit 30 performs the impedance matching function for the fully extended antenna. In a preferred embodiment, the matching circuitry 30 comprises an inductor/capacitor (LC) circuit. The inductor 30*b* and capacitor 30*a* can be placed upon the circuit board 26 in a conventional manner. In one embodiment, the capacitor is chosen to be 1.8 picofarads and the inductor is chosen to be 15 nanohenrys. In order to keep the matching network small, lumped element matching is used instead of distributed element matching. This allows for the first antenna element 22 to be as large as possible considering the size of the antenna shell 32.

The second antenna element 24 is movable within the shell 32. FIG. 1A shows the "closed" position in which a conductor portion 24*a* of the second antenna element 24 contacts a bypass switch 34. When the second antenna element 24 is in a closed position, the second antenna element 24 is directly connected to the antenna port, bypassing the matching circuitry 30 through a bypass switch. The bypass switch is designed so it doesn't introduce significant additional series impedance. This requires the bypass switch 34 to be as small as possible and as wide and flat a conductor as possible. In a preferred embodiment, the bypass switch is formed of sheet beryllium/copper (BeCu). In an alternative embodiment, the by-pass switch can connect the second antenna element to a second matching network (not shown).

In a preferred embodiment the second antenna element 24 has a non-conductive top portion 24*b*. The non-conductive top portion of 24*b* prevents the qualities of the antenna in the "closed" position from being corrupted when the top portion of the second antenna element 24 contacts the metal sleeve 36.

In a preferred embodiment, the second antenna element 24 , when in the "closed" position, acts as a roughly quarter wavelength antenna. Since the matching circuit 30 is designed for the fully extended antenna, the quarter wavelength antenna will operate more efficiently when the matching circuitry 30 is by-passed.

Figure 1B:
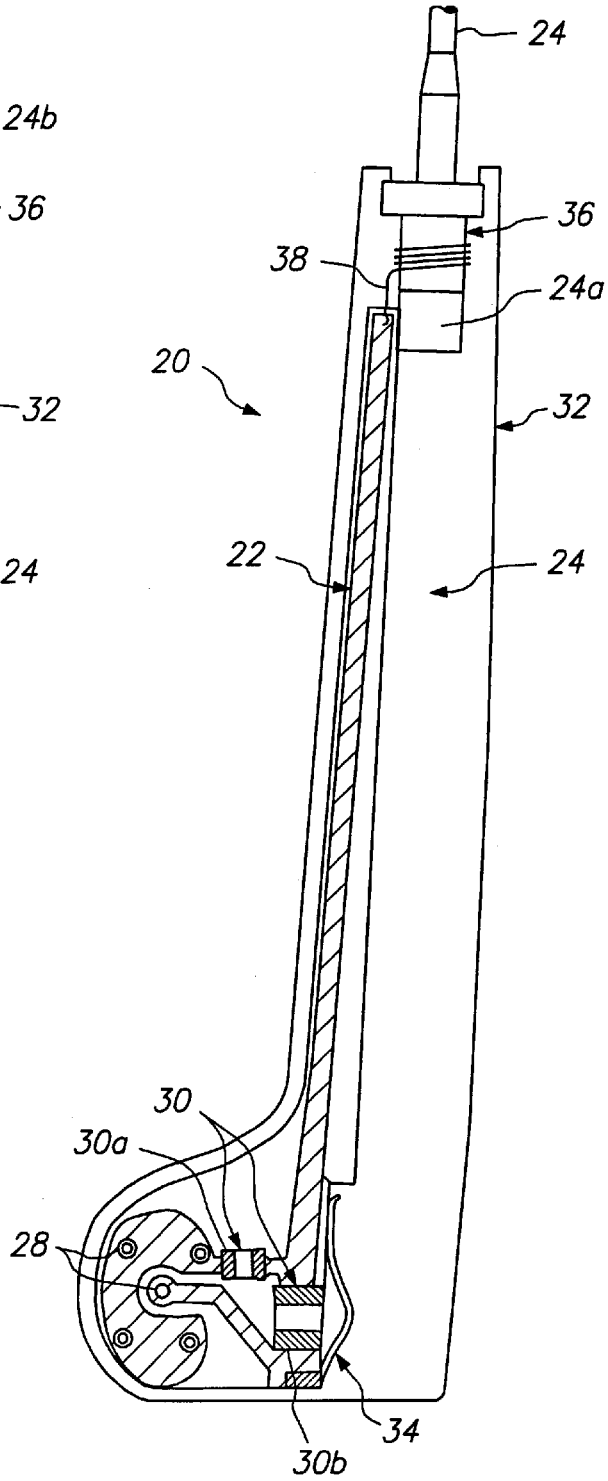
FIG. 1B is a diagram of the antenna of the present position in the "extended" position.

FIG. 1B shows the antenna 20 with the second antenna element 24 moved to the "expanded" position. In the "expanded" position, the conductive portion 24*a* of the second antenna element 24 contacts the conductive sleeve 36. The conductive sleeve 36 is connected by a conductive wire 38 to the top of the first antenna element 22. In the fully extended position, the first and second antenna element combine to produce a roughly half wavelength antenna. In one preferred embodiment, the length of the antenna is about 0.45 wavelengths long in order to ease the impedance matching with the matching circuitry 30. In a preferred embodiment, the antenna is designed to operate in the cellular bandwidth of 824–894 MHz.

The fully extended half wavelength antenna is the preferred configuration for the antenna operation. The half-wave antenna is not significantly dependant upon a counterpoise on which current can flow and create an image of the antenna. For this reason, the half-wave length antenna will be relatively insensitive to the poor ground plane available with personal computer cards.

By having the extendable antenna, the size of the antenna can be reduced by the user to allow it to fit in the relatively small space available for an antenna connected to the personal computer card.

A possible disadvantage of an extendable antenna is that it relies upon the user to extend and close the antenna. As discussed above with respect to FIG. 1A, by using the second antenna element alone and bypassing the matching circuit, the antenna can operate relatively well in the "closed" position.

The second antenna element 24 can be flexible. For example, the second antenna element 24 can be made of a wire surrounded by a flexible plastic cover except for the exposed conductor portion 24*a*.

Figure 2A:
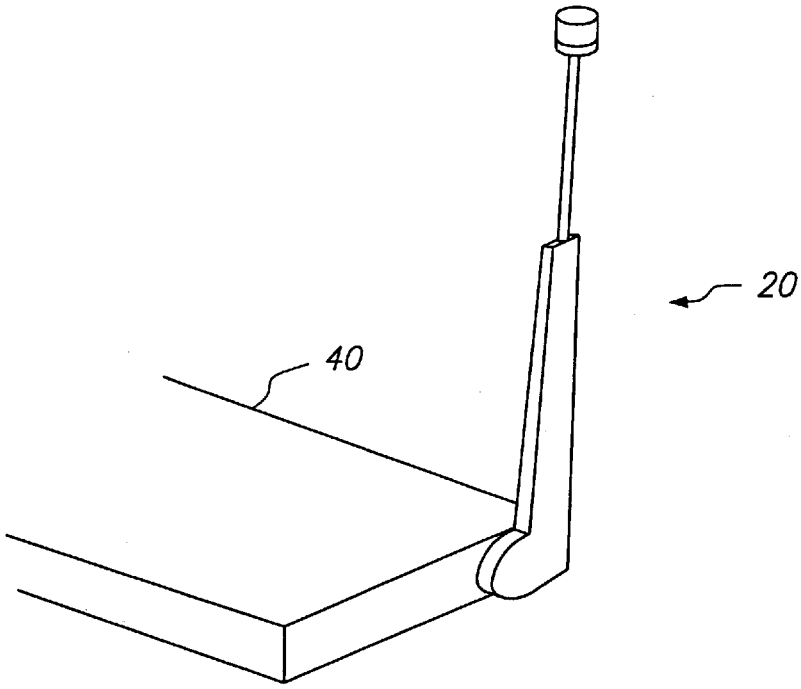
FIGS. 2A–2C are perspective views of the antenna of the present invention in different positions.
Figure 2B:
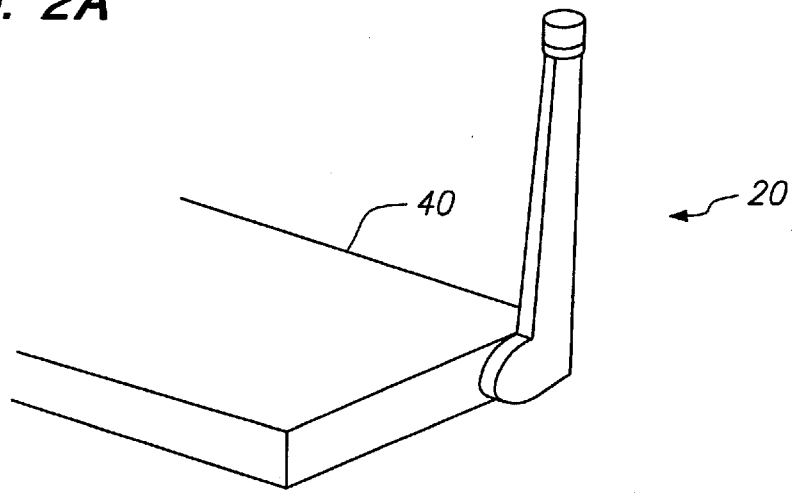
Figure 2C:
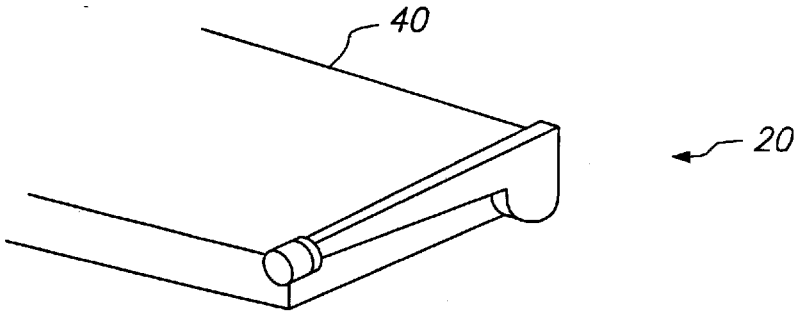

FIGS. 2A–2C show the antenna 20 connected to a Personal computer card 40. In FIG. 2A the antenna 20 is fully extended, so it operates as a roughly half-wavelength antenna. This is a preferred operation mode of the antenna.

FIG. 2B shows the antenna 20 erect in the closed position. In the closed position, the second antenna element contacts the bypass switch so that the second antenna element acts alone as a quarter wavelength antenna.

FIG. 2C shows the antenna 20 in the fully parked position. In this position the antenna is closed and rotated down alongside the personal computer card. The antenna does not operate in this position as well as it does in the position of FIG. 2B, but will be adequate in areas of good system coverage. The antenna will still operate as a quarter wavelength antenna in this position.

Figure 3:
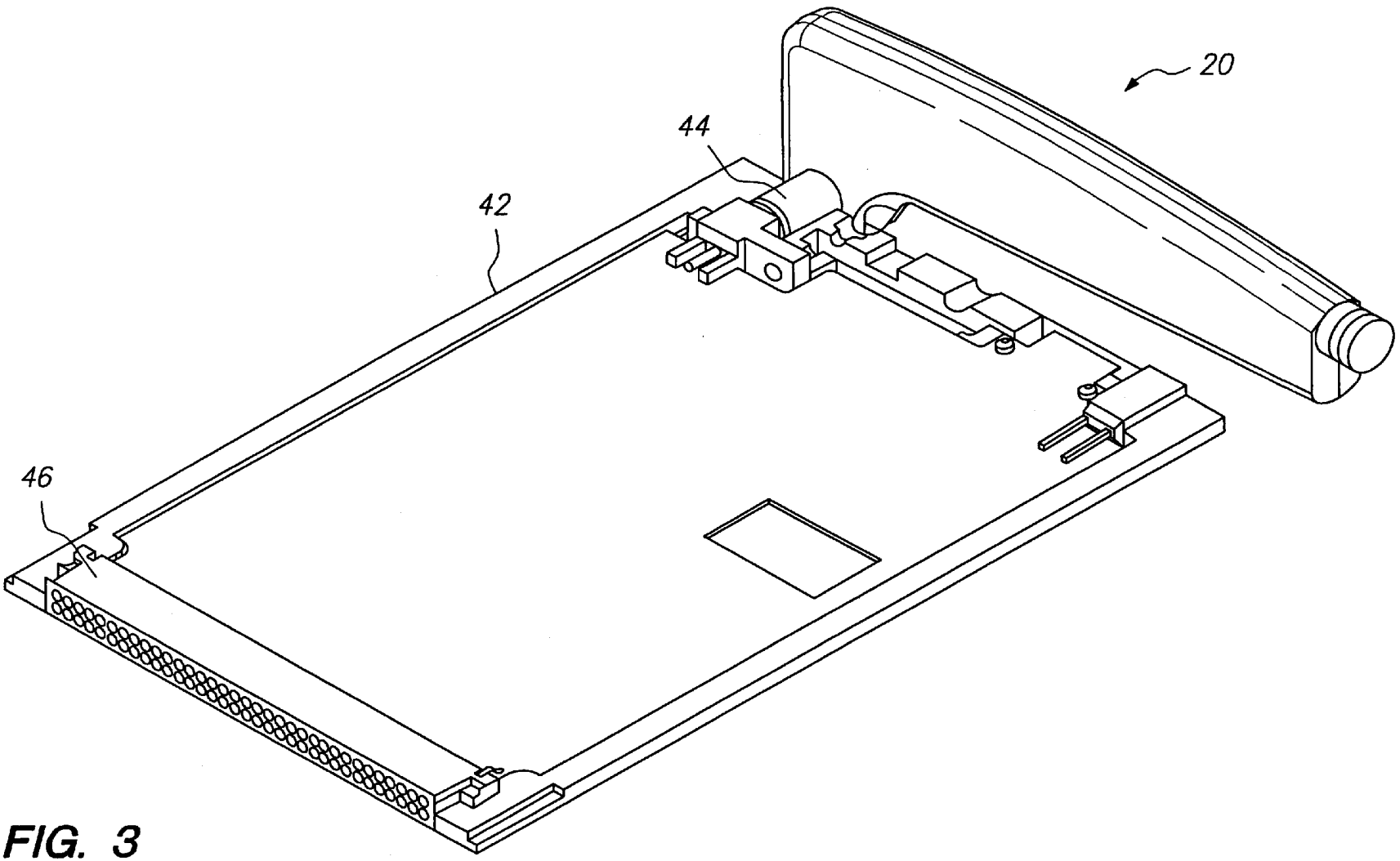
FIG. 3 is a perspective view that illustrates the interconnection of the antenna of the present invention to a personal computer card.

FIG. 3 shows the antenna 20 connected to a base of a Type II PCMCIA card. The base 42 shows the rotatable coax connector 44. Also shown is the PCMCIA connector 46.

The personal computer card can be connected to a battery pack as described in the co-pending application "Battery Case for a PCMCIA Card Modem with Antenna", Ser. No. 09/187,392, filed Nov. 06, 1998 (corresponding to Attorney Docket No. 024938-080) which is incorporated herein by reference.

It will appreciated by those of ordinary skill in the art that the invention can be embodied in other specific forms without departing from the spirit or essential character thereof. The presently disclosed embodiments are therefore considered in all respects to be illustrative and not restrictive. The scope of the invention is indicated by the appending claims rather than by the foregoing description, and all changes which come within the meaning and range of equivalents thereof are intended to be embraced herein.

What is claimed is:

1. An antenna comprising:

a first antenna element electrically connected at a first end to an antenna port through a matching circuit; and a second antenna element operably connected to the first antenna element, wherein the second antenna element can slide with respect to the first antenna element, and wherein when the second antenna element is in an extended position, a first end of the second antenna element electrically contacts a second end of the first antenna element, and when the second antenna element is in a closed position, the second antenna element is directly electrically connected to the antenna port bypassing the matching circuit.

2. The antenna of claim 1, wherein the antenna is smaller when the second antenna element is in the closed position.

3. The antenna of claim 1, wherein the first and second antenna element are elongated.

4. The antenna of claim 1, wherein the second antenna element is about a quarter of the center transmitted wavelength long.

5. The antenna of claim 4, wherein when the second antenna element is in the extended position the antenna is about half the center transmitted wavelength long.

6. The antenna of claim 1, wherein when the second antenna element is in the extended position the antenna is less than half the center transmitted wavelength long.

7. The antenna of claim 1, wherein the antenna has a rotatable attachment at the antenna port.

8. The antenna of claim 1, wherein the matching circuit is an LC circuit.

9. The antenna of claim 1, wherein the antenna port is a 50 ohm feed port.

10. The antenna of claim 1, wherein the second antenna element is held in place in the closed and extended positions but not held in place in other positions.

11. The antenna of claim 1, wherein the second antenna element is shaped broader at its base end.

12. The antenna of claim 11, wherein the base end of the second antenna element forms a conductive contact.

13. The antenna of claim 1, wherein a top portion of the second antenna element is covered with a non-conductive material.

14. The antenna of claim 1, further comprising a bypass switch for bypassing the matching circuit when the second antenna element is in the closed position.

15. The antenna of claim 14, wherein the bypass connection switch is a contact switch.

16. The antenna of claim 1, wherein the antenna is adapted for a Personal computer card.

17. The antenna of claim 1, wherein the antenna port is a coaxial connection.

18. The antenna of claim 17, wherein the antenna is rotatable about the coaxial connection.

19. The antenna of claim 1, wherein the second antenna element is flexible.

20. The antenna of claim 1, wherein the first antenna element is encased in a plastic shell, wherein the second antenna element is partially extendable out of the plastic shell.

21. An antenna comprising:

a first antenna element electrically connected at a first end to an antenna port through a matching circuit; and a second antenna element operably connected to the first antenna element, wherein the second antenna element can slide with respect to the first antenna element, and wherein when the second antenna element is in an extended position, a first end of the second antenna element electrically contacts a second end of the first antenna element, and when the second antenna element is in a closed position, the second antenna element is electrically connected to the antenna port bypassing the matching circuit, wherein the first antenna element comprises a metal trace on a circuit board.

22. The antenna of claim 21, wherein the matching circuit is formed on the circuit board.

23. An antenna comprising:

a first antenna element electrically connected at a first end to an antenna port through a matching circuit; and a second antenna element operably connected to the first antenna element, wherein the second antenna element can slide with respect to the first antenna element, and wherein when the second antenna element is in an extended position, a first end of the second antenna element electrically contacts a second end of the first antenna element, and when the second antenna element is in a closed position, the second antenna element is electrically connected to the antenna port bypassing the matching circuit, wherein when the second antenna element is in an extended position, the second antenna element and the first antenna element are electrically connected though a contact wire and metal sleeve.

* * * * *